US006811872B2

(12) United States Patent
Kasaoka et al.

(10) Patent No.: US 6,811,872 B2
(45) Date of Patent: Nov. 2, 2004

(54) FILAMENT MACHINE SEWING THREAD

(75) Inventors: Katsuyuki Kasaoka, Ishikawa (JP); Masahiro Higaki, Ehime (JP); Kenji Oobora, Osaka (JP); Genji Nakayama, Osaka (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/468,103

(22) PCT Filed: Aug. 14, 2002

(86) PCT No.: PCT/JP02/08277

§ 371 (c)(1),
(2), (4) Date: Aug. 15, 2003

(87) PCT Pub. No.: WO03/016603

PCT Pub. Date: Feb. 27, 2003

(65) Prior Publication Data

US 2004/0091703 A1 May 13, 2004

(30) Foreign Application Priority Data

Aug. 16, 2001 (JP) ..... 2001-246979
Aug. 17, 2001 (JP) ..... 2001-247720

(51) Int. Cl.[7] ..... D01F 6/00; D02G 3/36

(52) U.S. Cl. ..... 428/364; 428/395; 57/210; 57/211

(58) Field of Search ..... 428/364, 395; 57/211, 210

(56) References Cited

U.S. PATENT DOCUMENTS 6,425,237 B1 * 7/2002 Greifeneder et al. ..... 57/211
6,630,240 B2 * 10/2003 Yoshimura et al. ..... 428/364

FOREIGN PATENT DOCUMENTS

JP 5-106134 A 4/1993
JP 9-78335 A 3/1997

* cited by examiner

*Primary Examiner*—N. Edwards
(74) *Attorney, Agent, or Firm*—Sughrue Mion, PLLC

(57) ABSTRACT

A filament machine sewing thread comprising a spun combined filament yarn obtained by combining polyester filaments A having an intrinsic viscosity $[\eta]_F$ within the range of 0.7 to 1.2 with polyester filaments B having a lower intrinsic viscosity $[\eta]_F$ than that of the polyester filaments A by 0.2 to 0.7 and a higher elongation than that of the polyester filaments A in a spinning stage.

16 Claims, No Drawings

FILAMENT MACHINE SEWING THREAD

This application is a 371 of PCT/JP02/08277 filed Aug. 14, 2002.

TECHNICAL FIELD

The present invention relates to a filament machine sewing thread capable of forming uniform stitches while leaving gloss of filaments and having good high-speed sewability.

BACKGROUND ART

Filament machine sewing threads have been used for various kinds of sewing because of gloss as compared with that of machine sewing threads comprising spun yarns, uniform stitches and a high machine sewing thread strength; however, the filament machine sewing threads have disadvantages in that sewability in back stitching and zigzag chain stitching readily causing untwisting is inferior to that of the spun yarn machine sewing threads.

As for causes thereof, it is thought that drawing is carried out while applying a high thermal history using a polymer having a higher intrinsic viscosity than that of conventional polymers in order to retain the machine sewing thread strength which is a feature of the filament machine sewing threads at a high value, and that the torque of the primary and final twists applied in the subsequent step of forming the machine sewing threads is thereby not sufficiently set even after dyeing of the machine sewing threads to cause untwisting and the formation of stitches is not successful when carrying out the back stitching and zigzag chain stitching.

In order to solve the problems, JP-A 5-106134 (hereunder, JP-A means "Japanese Unexamined Patent Publication") discloses that a machine sewing thread having excellent sewability is obtained by forming a composite from two kinds of filament yarns having a difference in elongation of 20% or above and forming loops or slacknesses with the high-elongation yarn. In the machine sewing thread, however, there are problems that separation of the two kinds of filament yarns occurs and a bias is caused in the form of stitches to deteriorate uniformity or a difference in dyeability is conspicuous when the machine sewing thread is dyed.

JP-A 9-78335 discloses a filament machine sewing thread obtained by spinning and combining a filament yarn having a high birefringence with a filament yarn having a low birefringence and arranging the filament yarn having the low birefringence in a sheath part. The machine sewing thread has problems that the strength is lowered, the thread slips down from a bobbin, smooth thread feed cannot be made, breakage sometimes occurs and handleability is bad as compared with that of conventional filament machine sewing threads because only the difference in birefringence is utilized.

It is an object of the present invention to improve disadvantages caused by the formation of loops or slacknesses as described above and to provide a filament machine sewing thread capable of forming uniform stitches while leaving the gloss of filaments and having good high-speed sew ability.

DISCLOSURE OF THE INVENTION

As a result of intensive studies made to achieve the objects, the present inventors have found out that a desired filament machine sewing thread is obtained by suitably controlling the intrinsic viscosity $[\eta]_F$ and elongation of the filaments constituting the spun combined filament yarn within specific ranges. Thus, according to the invention, there is provided a filament machine sewing thread comprising a spun combined filament yarn in which polyester filaments $A_1$ having an intrinsic viscosity $[\eta]_F$ within the range of 0.7 to 1.2 and polyester filaments B having a lower intrinsic viscosity $[\eta]_F$ than that of the polyester filaments A by 0.2 to 0.7 and a higher elongation than that of the polyester filaments A are combined in a spinning stage.

BEST MODE FOR CARRYING OUT THE INVENTION

The mode for carrying out the invention will initially be detailed hereinafter.

In the present invention, the filament machine sewing thread is obtained by the so-called spinning filament combining method for simultaneously spinning polyester filaments A and polyester filaments B, then doubling the filaments A and B and simultaneously winding the doubled filaments.

Specifically, methods for leading polyester polymers different in intrinsic viscosity to the same spinneret, extruding the polyester polymers from separate discharge holes without mixing and winding the filaments together using a usual conjugate spinning machine or the like or methods for individually extruding the respective polymers from individually independent spinnerets, then doubling the filaments and winding the doubled filaments or the like can be adopted. In short, any methods may be used when both the filaments are united before completing the winding after the spinning.

Examples of the polyester used in the present invention include polyethylene terephthalate (hereinafter abbreviated to PET), polypropylene terephthalate, polybutylene terephthalate and the like. PET is most preferably exemplified.

It is necessary that the intrinsic viscosity of the polyester filaments A is high from aspects of heat resistance, abrasion resistance and strength, and it is necessary that the intrinsic viscosity $[\eta]_F$ of the spun filaments is within the range of 0.7 to 1.2. When the intrinsic viscosity exceeds 1.2, a large-scaled apparatus is required for polymerization and the cost is increased.

A polyester having a lower intrinsic viscosity $[\eta]_F$ than the intrinsic viscosity $[\eta]_F$ of the low-elongation filaments by 0.2 to 0.7 is used as the polyester filaments B. This is because the intrinsic viscosity of polyester filaments B is reduced to keep the polyester filaments B in a state of scarcely producing a thermal stress and the polyester filaments A having the residual torque is embraced with the polyester filaments B to thereby prevent the torque of the machine sewing thread from developing when carrying out the back stitching and zigzag stitching. In order to prevent the torque from developing, a difference in intrinsic viscosity of 0.2 or above is required. When the difference exceeds 0.7, the tenacity of the polyester filament filaments A becomes too low and breakage of single filaments occurs when sewing is carried out by a sewing machine to cause disturbance of stitches and lowering of uniformity. The difference in intrinsic viscosity is preferably 0.3 to 0.6.

The elongation of the polyester filaments B may be higher than that of the polyester filaments A; however, the elongation is usually higher for polyester filaments having a lower intrinsic viscosity when the same spinning conditions are adopted.

In the present invention, it is preferably that the polyester filaments contain an orientation inhibitor.

The orientation inhibitor herein refers to a substance having actions of inhibiting the orientation of the polyester filaments B and increasing the elongation. Specifically, examples of the orientation inhibitor include polystyrene polymers, polymethacrylate polymers or polymethylpentene polymers and the like; however, the orientation inhibitor is not limited to the polymers.

Optional methods can be adopted as a method for including the orientation inhibitor. For example, the orientation inhibitor may be included in a polymerization process of PET or the polymers may be melt mixed with PET, extruded, cooled, then cut and formed into chips. Further, both in a chip state are mixed and then directly melt spun.

The content of the orientation inhibitor is preferably 0.5 to 8.0% by weight based on the total weight of the filaments. When the content is lower than 0.5% by weight, effects on increase in elongation are not sufficiently produced. On the other hand, when the content exceeds 8.0% by weight, the strength of the filaments is extremely lowered and single filament breakage sometimes occurs even at low-speed rotation of a sewing machine. The content of the orientation inhibitor is preferably 0.5 to 5.0% by weight.

As mentioned above, the spinning filament combining method is adopted in the present invention. This is because it is necessary to adopt a spinning and winding method so as to mix the polyester filaments A with the polyester filaments B of the order of single filaments before the spinning and winding.

As a spinning filament combining method for especially providing good mixing, the polyester filaments A and the polyester filaments B may be spun from the same spinneret in which discharge holes of the spinneret are randomly dispersed, a spinneret comprising outer circular holes and inner circular holes or a bisected type spinneret.

The spinneret temperature is set at a temperature suitable for both the polymers when the polymers are extruded from the same spinneret; however, the spinneret temperature may respectively separately be set when separate spinnerets are used.

As for the spinning speed, the yarn strength after drawing is lowered as compared with that of the yarn spun at a low spinning speed though a difference in elongation after drawing is increased with increasing spinning speed. Therefore, a high spinning speed may be selected if an improvement in productivity rather than the yarn strength is desired. In addition, the production may be performed by a method in which spinning is directly connected to drawing. A method for achieving drawing only by high-speed spinning may be adopted.

In the present invention, the polyester filaments A and the polyester filaments B may be combined with filament-intermingled treatment by the intermingle device with the air blast before or after taking up the spun filaments. In the present invention, it is preferable that the filament strength of the polyester filaments A is higher and a filament strength of at least 5.0 g/dtex or above is required. The preferable strength is at least 5.4 g/dtex or above. On the other hand, a filament strength of 1.3 g/dtex or above withstanding friction or tensile stress when sewing is carried out by a sewing machine is required even in the case of the high-elongation filaments. The preferable strength is at least 1.5 g/dtex or above. A strength of at least 4.0 g/dtex or above is sufficient as the whole machine sewing thread. The preferable strength is at least 4.3 g/dtex or above.

The mixing ratio of the polyester filaments A to the polyester filaments B is preferably about 7:3 to 9:1. When the mixing ratio of the low-elongation filaments is lower than 7:3, a stress required for the machine sewing thread is insufficient. On the other hand, when the mixing ratio of the polyester filaments A exceeds 9:1, heat-setting properties of the polyester filaments B are sometimes insufficient so that it is difficult to suppress the development of torque of the machine sewing thread. The preferable range is 8:2.

Furthermore, the number of filaments in the polyester filaments A is preferably 8 or more and the number of filaments in the polyester filaments B is preferably 3 or more in order to sufficiently mix the polyester filaments A with the polyester filaments B. In the case of the number of combined yarns or less, a bias of mixing is sometimes caused to form nonuniform stitches. The sum total of the number of filaments in the polyester filaments A and the polyester filaments B is preferably within the range of 15 to 48. When the number is larger than the range, it is undesirable that there are disadvantages in making the single filament fineness too fine and lowering the yarn strength. Further, it is undesirable that the filaments tend toward dulling from aspects of gloss.

The machine sewing thread of the present invention provides a raw yarn for the machine sewing thread having good sewability by utilizing a difference in heat-setting properties due to a difference in intrinsic viscosity and a difference in elongation without relying on loops or slacknesses as opposed to conventional machine sewing threads. In short, it is presumed that heat transfer is prevented to improve the sewability because sufficient heat-setting effects are produced and single filament parts in the machine sewing thread in contact with a needle and a fabric during sewing are randomly replaced by making the low-elongation filaments and the high-elongation filaments in the machine sewing thread moderately migrate even without forming large loops or slacknesses such as the machine sewing thread disclosed in JP-A 5-106134.

Thus, in short, a part of the filaments have not suffered the friction with the needle or fabric for a long period and the single filament parts are continually replaced and can be passed through the needle or fabric without the damage. Therefore, a machine sewing thread capable of withstanding high-speed sewing can be obtained.

Further, it is thought that ultrafine crystal nuclei are produced in polyester filaments in which the orientation inhibitor is included to form a fibrous structure advantageous to heat-setting properties.

In the machine sewing thread of the invention, it is preferable to dye the machine sewing thread by applying a tension so as not to cause shrinkage of the machine sewing thread in the dyeing step of the machine sewing thread in order to minimize the nonuniformity of stitches caused by loops. Specifically, a method for collapsing cheeses formed by winding the machine sewing thread into the form of the cheeses in a dyeing kettle and dyeing the many cheeses at a time can be adopted. According to the method, loops are not formed even in the case of high-elongation filaments having high self-extensibility and a uniform filament machine sewing thread can be obtained because a tension is applied to the whole cheeses and the density of mutual filaments is high.

When the appearance of the machine sewing thread is to be spunized, loops can be developed by dyeing the machine sewing thread in a relaxed state. In this case, however, it is preferable to thoroughly restrict the formation of the loops to a small degree of spunizing of the appearance.

The present invention will be detailed by way of examples hereinafter. Physical properties in the examples were measured by the following methods.

(1) Intrinsic Viscosity $[\eta]_F$

The intrinsic viscosity was measured in o-chlorophenol at 25° C. by a conventional method. In the Examples 5 to 7, the intrinsic viscosity was measured the filaments without the orientation inhibiter produced under the same condition of the Examples.

(2) Lock Stitching High-speed Straight Sewability

Four T/R serges were sewn at a speed of 4000 rpm with a needle #14 by using a lock stitching single needle sewing machine for one minute and evaluation was made by rating the case wherein the appearance was rejected because the breakage of a machine sewing thread was present or single filament breakage frequently occurred as 1, the case wherein there was no practical problem though single filament breakage extremely slightly occurred as 2 and the case wherein no single filament breakage occurred at all as 3.

(3) Back Stitching Sewability

One T/R serge was sewn at a speed of 2000 rpm with a needle #11 in the back direction by using a lock stitching single needle sewing machine for 30 cm and evaluation was made by rating the case wherein the appearance was rejected because the breakage of a machine sewing thread was present or single filament breakage frequently occurred as 1, the case wherein there was no practical problem though single filament breakage extremely slightly occurred as 2 and the case wherein no single filament breakage occurred at all as 3.

EXAMPLES 1 to 4 AND COMPARATIVE EXAMPLES 1 to 3

(Production of Raw Yarns)

PET containing 0.02% by weight of titanium oxide was prepared as a polymer for polyester filaments A and PET without containing a delustering agent such as the titanium oxide was prepared as a polymer for polyester filaments B. Both the polymers were respectively dried at 160° C. for 4 hours.

Both the polymers were then melted at 300° C. The polymer for the polyester filaments A was then discharged from 15 holes and the polymer for the polyester filaments B was discharged from 5 holes by using a bisected type spinneret, cooled and solidified with air at room temperature in a cross-flow quench stack provided under the spinneret. A finish oil was applied to both the filaments in a combined filament state and the resulting yarn was then taken off at 1200 m/min to provide an 180 dtex/20 filaments undrawn yarn. The undrawn yarn was composed of 144 dtex polyester filaments A and 36 dtex polyester filaments B.

The undrawn yarn was fed to a drawing machine and drawn under the following conditions. Namely, the undrawn yarn was wound around a preheating roller having a diameter of 90 mm and set at a surface temperature of 90° C. at a speed of 200 m/min by six turns and then wound around a drawing setting roller having a diameter of 120 mm and set at a surface temperature of 140° C. at a speed of 600 m/min by four turns to complete drawing and heat-setting. The resulting yarn was subsequently wound around a secondary setting roller having a diameter of 120 mm and set at a surface temperature of 200° C. at a speed of 595 m/min by four turns, subjected to heat-setting and then wound. The average fineness of the resulting drawn yarn was 59 dtex.

(Production of Machine Sewing Threads)

S twists of 1050 T/M were applied to the drawn yarn. The resulting three yarns were combined and Z twists at 700 T/M were applied to provide a machine sewing thread which was wound into cheeses. The obtained cheeses were subjected to dyeing treatment at 130° C. for 40 minutes. The cheeses were treated in a state of the drawn yarn under a tension by a dyeing method for superimposing the cheeses and applying a compression load.

After drying, 3% of a silicone finish oil was applied to afford machine sewing threads.

Table 1 shows performances of the resulting drawn yarns and machine sewing threads. The strength and elongation of the polyester filaments A and the polyester filaments B in the drawn yarn are results obtained by making measurements of respective five single filaments randomly taken from the drawn yarns with a single filament strength and elongation measuring instrument as average values.

TABLE 1

| | Example 1 | Example 2 | Example 3 | Example 4 | (1) | (2) | (3) |
|---|---|---|---|---|---|---|---|
| Filaments A | | | | | | | |
| Intrinsic Viscosity | 1.11 | 1.11 | 0.98 | 0.72 | 0.62 | 0.85 | 1.11 |
| Strength (g/dtex) | 7.9 | 8.0 | 7.7 | 6.8 | 6.0 | 7.4 | 7.8 |
| Elongation (%) | 25 | 25 | 25 | 25 | 25 | 25 | 25 |
| Filaments B | | | | | | | |
| Intrinsic Viscosity | 0.42 | 0.64 | 0.64 | 0.51 | 0.42 | 0.75 | 0.31 |
| Strength (g/dtex) | 2.1 | 5.0 | 4.9 | 4.2 | 2.3 | 6.6 | 1.2 |
| Elongation (%) | 35 | 34 | 37 | 41 | 39 | 30 | 48 |
| Difference in intrinsic Viscosity | 0.69 | 0.47 | 0.32 | 0.21 | 0.20 | 0.10 | 0.80 |
| Drawn Yarn | | | | | | | |
| Strength (g/dtex) | 6.3 | 7.1 | 6.9 | 6.2 | 5.3 | 7.0 | 5.9 |
| Elongation (%) | 23 | 22 | 22 | 22 | 25 | 24 | 24 |
| Machine Sewing Thread | | | | | | | |
| Strength (g/dtex) | 5.7 | 6.1 | 5.9 | 5.3 | 4.6 | 5.9 | 5.7 |

TABLE 1-continued

| | Example 1 | Example 2 | Example 3 | Example 4 | (1) | (2) | (3) |
|---|---|---|---|---|---|---|---|
| Elongation (%) | 26 | 24 | 24 | 64 | 29 | 27 | 24 |
| Lock Stitching High speed Straight Sewability | 2 | 3 | 3 | 3 | 1 | 3 | 1 |
| Back Stitching Sewability | 2 | 3 | 3 | 3 | 1 | 1 | 1 |

Notes:
(1) means "Comparative Example 1".
(2) means "Comparative Example 2".
(3) means "Comparative Example 3".

Example 1 showed good sewability in both lock stitching and back stitching. Some single filament breakage was found in the appearance of the machine sewing thread after sewing at a level without any problem for practical use at all.

Examples 2 to 4 showed good sewability in both the lock stitching and the back stitching without any problem at all and the appearance of the machine sewing thread was uniform and rich in gloss.

Breakage of the machine sewing thread occurred in both the lock stitching and the back stitching in Comparative Example 1.

Comparative Example 2 showed good sewability without any problem in the lock stitching at all; however, breakage of the machine sewing thread occurred in the back stitching.

In Comparative Example 3, many single filament breakages and many single filament falloffs were caused in both the lock stitching and the back stitching and appearance was deficient in uniformity.

EXAMPLES 5 to 7 AND COMPARATIVE EXAMPLES 4 and 5

(Production of Raw Yarns)

PET without containing a delustering agent such as titanium oxide was prepared as a polymer for polyester filaments A and PET without containing a delustering agent such as the titanium oxide was prepared as a polymer for the polyester filaments B. Both the polymers were respectively dried at 160° C. for 4 hours.

The polymer for the polyester filaments B was then mixed with a polymethyl methacrylate (Delpet 80N manufactured by Asahi Chemical Industry Co., Ltd.) in a chip state in an amount of 0.5 to 8.0% as an orientation inhibitor and both the polymers were melted at 300° C. with a screw type melt extruder. The polymer for the polyester filaments A was discharged from 15 holes and the polymer for the polyester filaments B was discharged from 5 holes using a bisected type spinneret, cooled and solidified with air at room temperature in a cross-flow quench stack provided under the spinneret. A finish oil was applied to both the filaments in a combined state and the resulting yarn was taken up at 1200 m/min to afford a 180 dtex/20 filaments undrawn yarn. The resulting undrawn yarn was composed of 144 dtex low-elongation filaments and 36 dtex high-elongation filaments.

The resulting undrawn yarn was fed to a drawing machine and drawn under the following conditions. Namely, the undrawn yarn was wound around a preheating roller having a diameter of 90 mm and set at a surface temperature of 90° C. at a speed of 200 m/min by 6 turn and then wound around a drawing setting roller having a diameter of 120 mm and set at a surface temperature of 140° C. at a speed of 600 m/min by 4 turns to complete drawing and heat-setting. The resulting yarn was subsequently wound around a secondary setting roller having a diameter of 120 mm and set at a surface temperature of 200° C. at a speed of 595 m/min by 4 turns, heat-set and then wound. The average fineness of the drawn yarn was 59 dtex.

(Production of Machine Sewing Threads)

S twists at 700 T/M were applied to the drawn yarn. The resulting three yarns were combined and Z twists at 1050 T/M were then applied to provide a machine sewing thread, which was wound into cheeses and subjected to dyeing treatment at 130° C. for 40 minutes. The cheeses were treated in a state of the drawn yarn under a tension by a dyeing method for superimposing the cheeses and applying a compression load.

After drying, 3% of a silicone finish oil was applied to afford machine sewing threads.

Table 2 shows performances of the resulting drawn yarns and machine sewing threads. Furthermore, the strength and elongation of the polyester filaments A and the polyester filaments B in the drawn yarn are results obtained by making measurements of respective five single filaments randomly taken out from the drawn yarns with a single filament strength and elongation measuring instrument as average values.

TABLE 2

| | Example 5 | Example 6 | Example 7 |
|---|---|---|---|
| Filaments A | | | |
| Intrinsic Viscosity | 0.88 | 0.88 | 0.88 |
| Strength (g/dtex) | 6.4 | 5.8 | 5.5 |
| Elongation (%) | 25 | 25 | 25 |
| Filaments B | | | |
| Intrinsic Viscosity | 0.61 | 0.61 | 0.61 |
| Amount of Orientation Inhibitor (%) | 0.5 | 5.0 | 8.0 |
| Strength (g/dtex) | 3.9 | 2.9 | 2.3 |
| Elongation (%) | 55 | 74 | 89 |
| Difference in intrinsic Viscosity | 0.27 | 0.27 | 0.27 |
| Drawn Yarn | | | |
| Strength (g/dtex) | 5.6 | 5.2 | 5.0 |
| Elongation (%) | 24 | 24 | 23 |
| Machine Sewing Thread | | | |
| Strength (g/dtex) | 4.9 | 4.6 | 4.3 |
| Elongation (%) | 27 | 27 | 26 |

TABLE 2-continued

| | Example 5 | Example 6 | Example 7 |
|---|---|---|---|
| Lock Stitching High-speed Straight Sewability | 3 | 3 | 2 |
| Back Stitching Sewability | 3 | 3 | 2 |

Examples 5 and 6 showed good sewability in both the lock stitching and the back stitching without any problem at all and the appearance of the machine sewing thread was uniform and rich in gloss.

Example 7 showed good sewability in both the lock stitching and the back stitching. Some single filament breakage was found in appearance of the machine sewing thread after sewing at a level without any problem at all for practical use.

INDUSTRIAL APPLICABILITY

According to the present invention, disadvantages caused by the formation of loops or slacknesses possessed by conventional machine sewing threads are improved, and there is provided a filament machine sewing thread capable of forming uniform stitches while leaving gloss of filaments and having good high-speed sewability.

What is claimed is:

1. A filament machine sewing thread comprising a spun combined filament yarn obtained by combining polyester filaments A having an intrinsic viscosity $[\eta]_F$ within the range of 0.7 to 1.2 with polyester filaments B having a lower intrinsic viscosity $[\eta]_F$ than that of the polyester filaments A by 0.2 to 0.7 and a higher elongation than that of the polyester filaments A in a spinning stage.

2. The filament machine sewing thread as claimed in claim 1, wherein a filament strength of the polyester filaments A is at least 5.0 g/dtex or above.

3. The filament machine sewing thread as claimed in any of claim 1 or 2, wherein a filament strength of the polyester filaments B is at least 1.3 g/dtex or above.

4. The filament machine sewing thread as claimed in claim 1, wherein a strength of the filament machine sewing thread is at least 4.0 g/dtex or above.

5. The filament machine sewing thread as claimed in claim 1, wherein a mixing ratio of the polyester filaments A to the polyester filaments B is in the range of 7:3 to 9:1 of the spun combined filament yarn.

6. The filament machine sewing thread as claimed in claim 1, wherein the polyester filaments B contain an orientation inhibitor.

7. The filament machine sewing thread as claimed in claim 6, wherein a content of the orientation inhibitor is the range of 0.5 to 0.8 by weight based on a total weight of the polyester filaments B.

8. The filament machine sewing thread as claimed in claim 6, wherein the orientation inhibitor is at least one selected from polystyrene polymers, polymethacrylate polymers and polymethylpentene polymers.

9. The filament machine sewing thread as claimed in claim 2, wherein a strength of the filament machine sewing thread is at least 4.0 g/dtex or above.

10. The filament machine sewing thread as claimed in 3, wherein a strength of the filament machine sewing thread is at least 4.0 g/dtex or above.

11. The filament machine sewing thread as claimed in claim 2, wherein a mixing ratio of the polyester filaments A to the polyester filaments B is in the range of 7:3 to 9:1 of the spun combined filament yarn.

12. The filament machine sewing thread as claimed in claim 3, wherein a mixing ratio of the polyester filaments A to the polyester filaments B is in the range of 7:3 to 9:1 of the spun combined filament yarn.

13. The filament machine sewing thread as claimed in claim 4, wherein a mixing ratio of the polyester filaments A to the polyester filaments B is in range of 7:3 to 9:1 of the spun combined filament yarn.

14. The filament machine sewing thread as claimed in claim 2, wherein the polyester filaments B contain an orientation inhibitor.

15. The filament machine sewing thread as claimed in claim 3, wherein the polyester filaments B contain an orientation inhibitor.

16. The filament machine sewing thread as claimed in claim 4, wherein the polyester filaments B contain an orientation inhibitor.

* * * * *